United States Patent [19]

Kozuka et al.

[11] 4,400,077

[45] Aug. 23, 1983

[54] PHOTOSENSITIVE DRUM FOR ELECTROSTATIC COPYING APPARATUS

[75] Inventors: Nobuhiko Kozuka, Suita; Ryutaro Yamagata, Nishinomiya; Shigeo Koyama, Toyonaka; Hiromi Sakata, Neyagawa; Atsushi Kano, Amagasaki, all of Japan

[73] Assignee: Mita Industrial Company Limited, Osaka, Japan

[21] Appl. No.: 313,975

[22] Filed: Oct. 22, 1981

[30] Foreign Application Priority Data

Nov. 12, 1980 [JP] Japan ..... 55-159874

[51] Int. Cl.[3] ..... G03G 15/00

[52] U.S. Cl. ..... 355/3 DR; 29/123

[58] Field of Search ..... 355/3 DR, 3 R, 3 SC; 29/121.6, 123, 124, 125

[56] References Cited

U.S. PATENT DOCUMENTS 3,615,131 10/1971 Sable et al. ..... 355/14
3,955,889 5/1976 Ishiguro et al. ..... 355/3 R
4,134,667 1/1979 Schnall et al. ..... 355/3 DR
4,239,375 12/1980 Eisbein et al. ..... 355/3 DR X
4,344,700 8/1982 Kasama et al. ..... 355/3 DR X

*Primary Examiner*—A. C. Prescott
*Attorney, Agent, or Firm*—Wenderoth, Lind & Ponack

[57] ABSTRACT

A photosensitive drum assembly for an electrostatic copying apparatus includes a cylindrical drum having a photosensitive layer provided around its outer periphery. The drum is held between a pair of flanges at opposite axial ends of the drum. Each of the flanges is formed having a diameter larger than the external diameter of the drum. At the edge of each flange, is a cylindrical portion extending along the axis of the drum to face toward the opposite flange. The end edges of the drum closely fit into the cylindrical portions. According to the present invention, since the edges of the drum closely fit into the cylindrical portions of the flanges, it is not necessary to improve the dimensional accuracy of the inside periphery of the opposite ends of the drum, while it is essential to improve the dimensional accuracy in a conventional manner.

5 Claims, 4 Drawing Figures

PHOTOSENSITIVE DRUM FOR ELECTROSTATIC COPYING APPARATUS

BACKGROUND OF THE INVENTION

1. Field of the Invention

The present invention relates to a photosensitive drum for use in an electrostatic copying apparatus, which is constituted by holding a cylindrical drum, having a photosensitive member or photosensitive layer provided around its outer periphery, between a pair of flanges extending axially from opposite ends of the drum.

2. Description of the Prior Art

Referring to FIG. 1, a conventional photosensitive drum is generally so arranged that, in the inner faces at opposite ends of a drum 2 having a photosensitive member 1 (thickness thereof is shown on an enlarged scale in FIG. 1 for convenience of explanation) provided around its outer peripheral surface, there are respectively formed fitting portions 7 and 8 having inner peripheral faces 7*a* and 8*a*, into which are fitted outer peripheral faces 5*a* and 6*a* of corresponding fitting portions 5 and 6 of flanges 3 and 4. In the known photosensitive drum as described above, for minimizing as far as possible the deviation or vibration of the external diameter of the drum along its circumferential direction with respect to an axis of a rotary shaft 9, it is necessary to improve the fitting accuracy between the outer peripheral faces 5*a* and 6*a* of the fitting portions 5 and 6 and the inner peripheral faces 7*a* and 8*a* of the fitting portions 7 and 8, and also the concentricity between the outer peripheral surface of the drum 2 and the inner peripheral faces 7*a* and 8*a* of the fitting portions 7 and 8. In connection with the above, there is a possibility that a deviation in the external diameter of the drum 2 tends to be increased or amplified due to a synergistic effect of deviation in the fitting tolerance between the outer peripheral faces 5*a* and 6*a* and the inner peripheral faces 7*a* and 8*a*, and also in the tolerance of the concentricity between the outer peripheral surface of the drum 2 and the inner peripheral faces 7*a* and 8*a* of the fitting portions 7 and 8. Moverover, in the prior art arrangement as described above, when the photosensitive drum is withdrawn from the apparatus housing for inspection or maintenance, it has been necessary to place the photosensitive drum perpendicularly on a plane or surface since there is a danger that the photosensitive member 1 may be damaged due to contact with the plane if it is placed thereon horizontally.

Accordingly, it is a primary object of the present invention to provide an improved photosensitive drum which is arranged to minimize the deviation in the external diameter of the drum as far as possible, and also to be free from any damage to its photosensitive member, even when the drum is placed horizontally, through substantial elimination of the technical problems as described earlier inherent in conventional photosensitive drums.

SUMMARY OF THE INVENTION

To accomplish the foregoing objective, there is provided an improved photosensitive drum which comprises a pair of flanges each formed to have a diameter larger than the external diameter of the drum. At the edge of each flange is a cylindrical portion extending parallel to the axis of the drum to face to the opposite flange, and the edge of the drum closely fits into the cylindrical portions.

Inside the photosensitive drum, there is provided a connecting rod which is threaded at opposite ends thereof to be engaged with screw members for tightening the flanges in the directions toward each other.

According to the present invention, since the edges of the drum closely fit into the cylindrical portions of the flanges, it is not necessary to improve the dimensional accuracy of the inside periphery of the opposite ends of the drum, while it is essential to improve such dimensional accuracy in a conventional drum. Since only two fitting portions need be produced with tolerances sufficient to avoid the possibility of geometric amplification of deviations of dimensions in the radial direction, namely the outer peripheral surface of the drum and the inner peripheral faces of the cylindrical portions, and such number is smaller than in prior structure, undesirable deviations in the external diameter largely are reduced compared with the prior art structures. In addition, since the cylindrical portions, having diameters larger than the external diameter of the drum, are respectively formed at the opposite ends of the photosensitive drum of the present invention, the photosensitive drum may be placed horizontally without danger of damange to the photosensitive surface.

BRIEF DESCRIPTION OF THE DRAWINGS

A detailed description of the invention will be made with reference to the accompanying drawings wherein like numerals designate corresponding parts in the various figures.

DETAILED DESCRIPTION OF THE PREFERRED EMBODIMENT

The following detailed description is of the best presently contemplated mode of carrying out the invention. This description is not to be taken in a limiting sense, but is merely for the purpose of illustrating the general principles of the invention since the scope of the invention is best defined by the appended claims.

The present invention relates to a photosensitive drum for use in an electrostatic copying apparatus, which is constituted by holding a cylindrical drum having a photosensitive member or photosensitive layer provided around its outer periphery between a pair of flanges extending axially from opposite ends of the drum.

Figure 1:
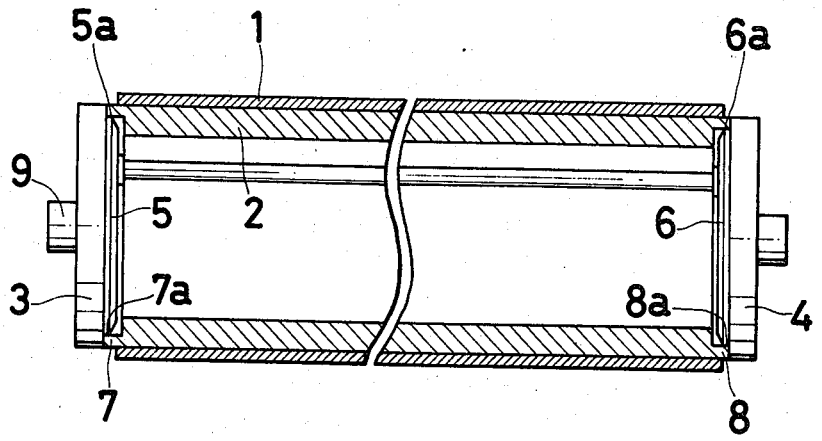
Fig. 1 Prior Art
FIG. 1 is a sectional view of a conventional photosensitive drum.
Figure 2:
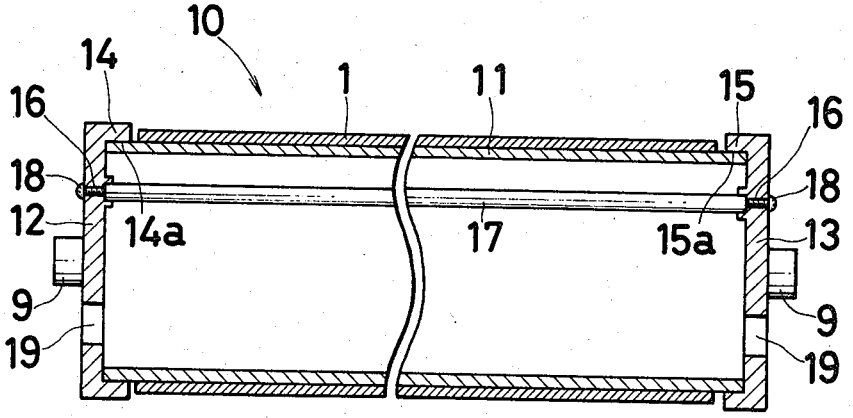
FIG. 2 is a sectional view of an improved photosensitive drum according to one preferred embodiment of the present invention.

FIG. 2 is a schematic side sectional view of an improved photosensitive drum according to one preferred embodiment of the present invention, in which portions corresponding to those in the prior art drum of FIG. 1 are designated by the same reference numerals.

In FIG. 2, the photosensitive drum 10 of the present invention generally includes a drum 11 having a photosensitive member or photosensitive layer 1 provided around the outer peripheral surface thereof, flange members or flanges 12 and 13 for closing opposite end portions of drum 11, and connecting rods 17 for connecting flanges 12 and 13 to each other so as to hold drum 11 therebetween.

Both of the flanges 12 and 13 are fundamentally of a disc-like configuration and are each formed to have a diameter larger than the external diameter of the drum 11. At the central portion of each of the flanges 12 and 13, a rotary shaft 9 is concentrically provided to extend or project outwardly therefrom in an axial direction of the drum 11 as shown. Meanwhile, around the peripheral edges of the flanges 12 and 13 are formed respective cylindrical portions 14 and 15 extending in directions toward each other and parallel to the axis of the drum 11. Inner peripheral faces 14*a* and 15*a* of the above cylindrical portions 14 and 15 correspond in size to the outer peripheral surface of the drum 11 for receiving therein the corresponding ends of drum 11.

The flanges 12 and 13 are each formed with a plurality of bores or through-holes, for example three bores 16, directed in a direction parallel to the axis of the drum 11 and equally spaced in the circumferential direction. The connecting rods 17 extending between the flanges 12 and 13 are respectively disposed to correspond to bores 16. Each of the connecting rods 17 is formed, at its opposite ends, with internal threads in its axial direction, and screw members 18 engageable with such internal threads are threaded into the connecting rod 17 through each of the bores 16. By threading the screw members 18 into the internal threads of the rods 17, both of the flanges 12 and 13 are tightened in directions toward each other, whereby the drum 11 is rigidly held between flanges 12 and 13. Furthermore, in the flanges 12 and 13, there are respectively formed support openings 19. The photosensitive drum 10 is supported by inserting fingers into the support openings 19 when the drum is withdrawn from the copying apparatus housing for inspection or maintenance.

In the photosensitive drum 10 as described above, for reducing undesirable deviation in the external diameter of the drum 11, it is only required to improve the concentricity between the inner peripheral faces 14*a* and 15*a* of the cylindrical portions 14 and 15 and the outer peripheral surface of the drum 11, and also the dimensional accuracy. Meanwhile, at the opposite end portions of the photosensitive drum 10, since the cylindrical portions 14 and 15 are arranged to have a diameter larger than the outer peripheral surface of the drum 11, there is no possibility that the photosensitive member 1 of the drum 11 is injured due to contact thereof with a surface, even if the photosensitive drum 10 is placed horizontally on such surface.

Figure 3:
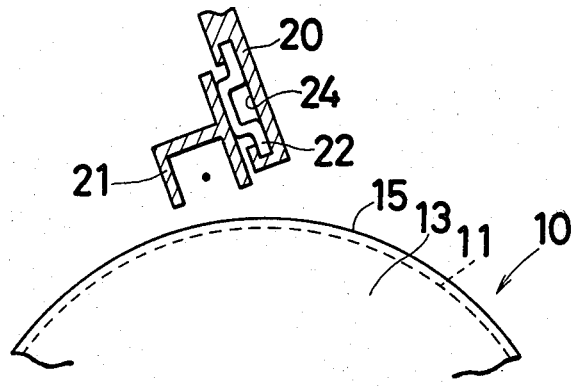
FIG. 3 is a partion sectional view showing the photosensitive drum and a charging corona discharger, both of which are mounted on an electrostatic copying apparatus.
Figure 4:
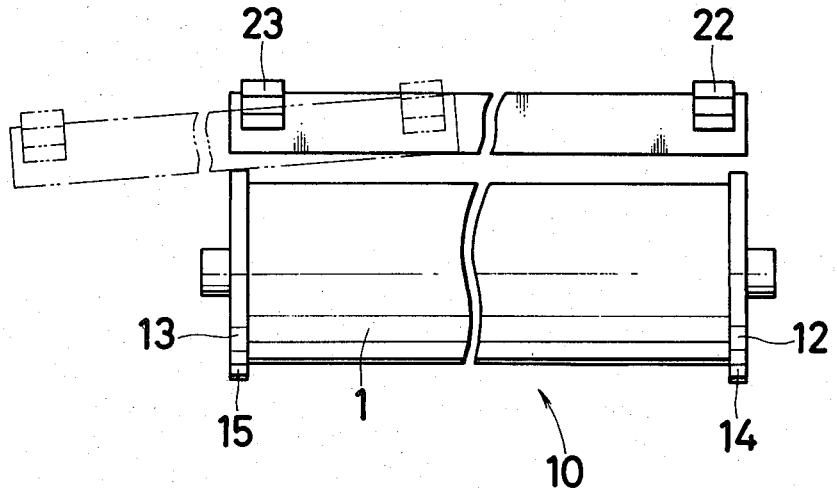
FIG. 4 is is an end view from the right side of FIG. 3, wherein a guide member is omitted.

By the employment of the photosensitive drum 10 as described in the foregoing, when members disposed around the photosensitive drum 10 are to be attached into or detached from the apparatus housing, it is possible to prevent damage to the photosensitive drum 10 due to contact of such members with the photosensitive member 1. More specifically, referring to FIG. 3, assume for example, that a charging corona discharger 21 is movably provided along a guide member 20 parallel to the axis of the photosensitive drum 10. To the opposite ends of charging corona discharger 21, along the axis of the photosensitive drum 10, there are secured, as shown in FIG. 4, support members 22 and 23, which are movably fitted in a guide groove 24 of the guide member 20. In the state where the support members 22 and 23 are fitted in the guide groove 24, the charging corona discharger 21 is supported in a direction parallel to the axis of the photosensitive drum 10 as shown in the solid line in FIG. 4.

By the arrangement as described above, when the charging corona discharger 21 is moved along the guide member 20 for mounting or detachment thereof, there is a state where only one support member 22 is fitted in the guide groove 24. In such a state as described above, there may be a case in which the charging corona discharger 21 is held in a posture where it is inclined with respect to the axis of the photosensitive drum 10, as represented by the dashed lines in FIG. 4. Therefore, there is a possibility that the charging corona discharger 21 may contact and damage the photosensitive member 1 of the drum 10 during insertion or withdrawal of charging corona discharger 21 in such an inclined state. However, in the arrangement of the present invention, since the cylindrical portions 14 and 15 having a diameter larger than the external diameter of the drum 11, and the photosensitive member 1, are provided at the opposite ends in the axial direction of the photosensitive drum 10, the charging corona discharger 21, even when inclined as described earlier, is brought into contact only with these cylindrical portions 14 and 15, and therefore, there is no danger that the photosensitive member 1 should be undesirably injured or damaged.

What is claimed is:

1. A photosensitive drum assembly capable of being, as a unit, mounted on and detached from an electrostatic copying apparatus, said assembly comprising:

a cylindrical drum having provided around the outer peripheral surface thereof a photosensitive member, said drum having a center axis and axially opposite ends;

a pair of flange members fitted over respective said ends of said drum, each said flange member including a disc-shaped portion adjacent a respective end surface of said drum and an integral cylindrical flange portion extending axially from said disc-shaped portion toward the other said flange memeber, said flange portion having an inner cylindrical surface in contact with a respective end portion of said outer peripheral surface of said drum, and said flange portion having an outer peripheral surface having a diameter greater than the diameter of the outer surface of said photosensitive member;

at least one connecting rod extending through the interior of said drum in a direction parallel to said axis between said disc-shaped portions of said flange members; and threadable means, associated with opposite ends of said connecting rod, for threadably connecting said disc-shaped members to said connecting rod, and thereby for urging said flange members toward each other, whereby said drum and flange members form a unit which is mountable on and detachable from an electrostatic copying apparatus.

2. An assembly as claimed in claim 1, wherein each said disc-shaped portion has integrally extending therefrom a rotary shaft aligned concentrically of said axis.

3. An assembly as claimed in claim 1, wherein each said disc-shaped portion has therethrough at least one support opening to enable an operator to insert fingers therethrough and to lift and support said assembly.

4. An assembly as claimed in claim 1, comprising a plurality of said connecting rods.

5. An assembly as claimed in claim 1, wherein opposite ends of said connecting rod are internally threaded and abut respective said disc-shaped portions, and said threadable means comprise screw members extending through bores in respective said disc-shaped portions and threaded into the internal threads of respective said ends of said connecting rod.

* * * * *